US006147581A

United States Patent [19]

Rancourt et al.

[11] Patent Number: 6,147,581

[45] Date of Patent: Nov. 14, 2000

[54] UNIVERSAL TRANSFORMER TANK FOR POLE-MOUNTED DISTRIBUTION TRANSFORMERS

[75] Inventors: Pier-André Rancourt, Beauport; Alain Tremblay, Québec, both of Canada

[73] Assignee: Asea Brown Boveri Inc., Québec , Canada

[21] Appl. No.: 09/442,345

[22] Filed: Nov. 17, 1999

[51] Int. Cl.[7] ..... H01F 27/06

[52] U.S. Cl. ..... 336/65; 336/67

[58] Field of Search ..... 336/92, 90, 65, 336/59, 60, 58, 67

[56] References Cited

U.S. PATENT DOCUMENTS 3,685,682 8/1972 Frey, III ..... 220/359
4,005,341 1/1977 Uptegraff, Jr. et al. ..... 361/38
4,219,791 8/1980 Moore et al. ..... 336/58
5,225,630 7/1993 Hopkinson et al. ..... 174/16.1
5,337,034 8/1994 Grimes ..... 336/92

*Primary Examiner*—Lincoln Donovan
*Assistant Examiner*—Anh Mai
*Attorney, Agent, or Firm*—Swabey Ogilvy Renault; Guy J. Houle

[57] ABSTRACT

A universal transformer tank for distribution transformers is comprised of a cylindrical housing having a circumferential side wall, a bottom wall and an open top end. A cover is removably secured on the open top end. An adjustable clamping assembly is secured inside the housing above the bottom wall and has adjustable clamping means to secure distribution transformers of varying configurations capacities and size inside the housing.

11 Claims, 3 Drawing Sheets

UNIVERSAL TRANSFORMER TANK FOR POLE-MOUNTED DISTRIBUTION TRANSFORMERS

TECHNICAL FIELD

The present invention relates to a universal transformer tank for distribution transformers and provided with adjustable clamping means whereby to receive and secure therein core and coil assembly of different capacities, sizes and configurations. Particularly, but not exclusively, the tank is of the pole-mounted type.

PRIOR ART

Various companies fabricate distribution transformers and these may have different capacities, for example from 25 kVA to 167 kVA. Depending on the capacity of the transformer the size thereof will vary and each of these different size transformers must be accommodated in a custom-built tank. Accordingly, the tank size will vary depending on the capacity of the distribution transformer. Also, different companies manufacture transformers having different outlines or configurations, which also affects the size and configuration of the tank in which a transformer is secured. Accordingly, there is a multitude of size of distribution transformers on the market and in use. These transformers are filled with insulating oil as is well known in the art. Further, most of these distribution transformers are of the pole-mounted type and accordingly it is necessary to provide one or more mounting bracket or lug on the outside of the tank to secure same to fastening devices which are usually permanently secured to the post. The fastening devices accommodate a particular tank.

Because there are several types and sizes of distribution transformers this poses a problem to electrical utilities. One problem is that an inventory of these different types and size distribution transformers must be maintained to replace defective transformers. A transformer can fail several years after its installation while the tank in which this transformer is housed remains in good condition. However, it is necessary to remove the transformer from its post and to replace it with another transformer. The old transformer is usually discarded.

After several years it is likely that the replacement transformer may be supplied in a different tank size by a different supplier. Maintaining a large inventory of transformers is also very costly to the utility. The replacement time is also costly to the utility.

DISCLOSURE OF THE INVENTION

It is therefore a feature of the present invention to overcome the above-mentioned disadvantages of prior art distribution transformers.

Another feature of the present invention is to provide a universal tank for distribution transformers and capable of securing therein one of a plurality of differently configured and sized core and coil assembly and of differing capacities, usually from about 25 kVA to 167 kVA.

Another feature of the present invention is to provide a universal transformer tank for distribution transformers which is provided therein with adjustable clamping means to secure core and coil assembly of varying configurations inside the housing manufactured by different companies.

Another feature of the present invention is to provide a new universal transformer tank for distribution transformers and wherein the core and coil may be reused several times and further wherein the core and coil assembly permits an electrical utility to maintain a smaller inventory of distribution transformers.

According to the above features, from a broad aspect, the present invention provides a universal transformer tank for distribution transformers and wherein the tank is comprised of a cylindrical housing having a circumferential side wall, a bottom wall and an open top end. A cover is removably secured on the open top end. An adjustable clamping assembly is secured inside the housing above the bottom wall and has adjustable clamping means to secure core and coil assembly of varying sizes inside the housing.

According to a further broad aspect of the present invention there is provided a universal transformer tank as above-described and wherein adjustable hold-down means is further provided inside the tank to clampingly engage an upper core section of a core and coil assembly supported in the housing with a lower core section being supported on the adjustable clamping means which is secured above the bottom wall of the tank.

According to still another broad aspect of the present invention there is provided a universal transformer tank which is dimensioned to receive therein one of a plurality of differently configured and sized core and coil assembly of differing capacities from about 25 kVA to 167 kVA manufactured by different companies.

BRIEF DESCRIPTION OF THE DRAWINGS

A preferred embodiment of the present invention will now be described with reference to the accompanying drawings in which.

DESCRIPTION OF THE PREFERRED EMBODIMENTS

Figure 1:
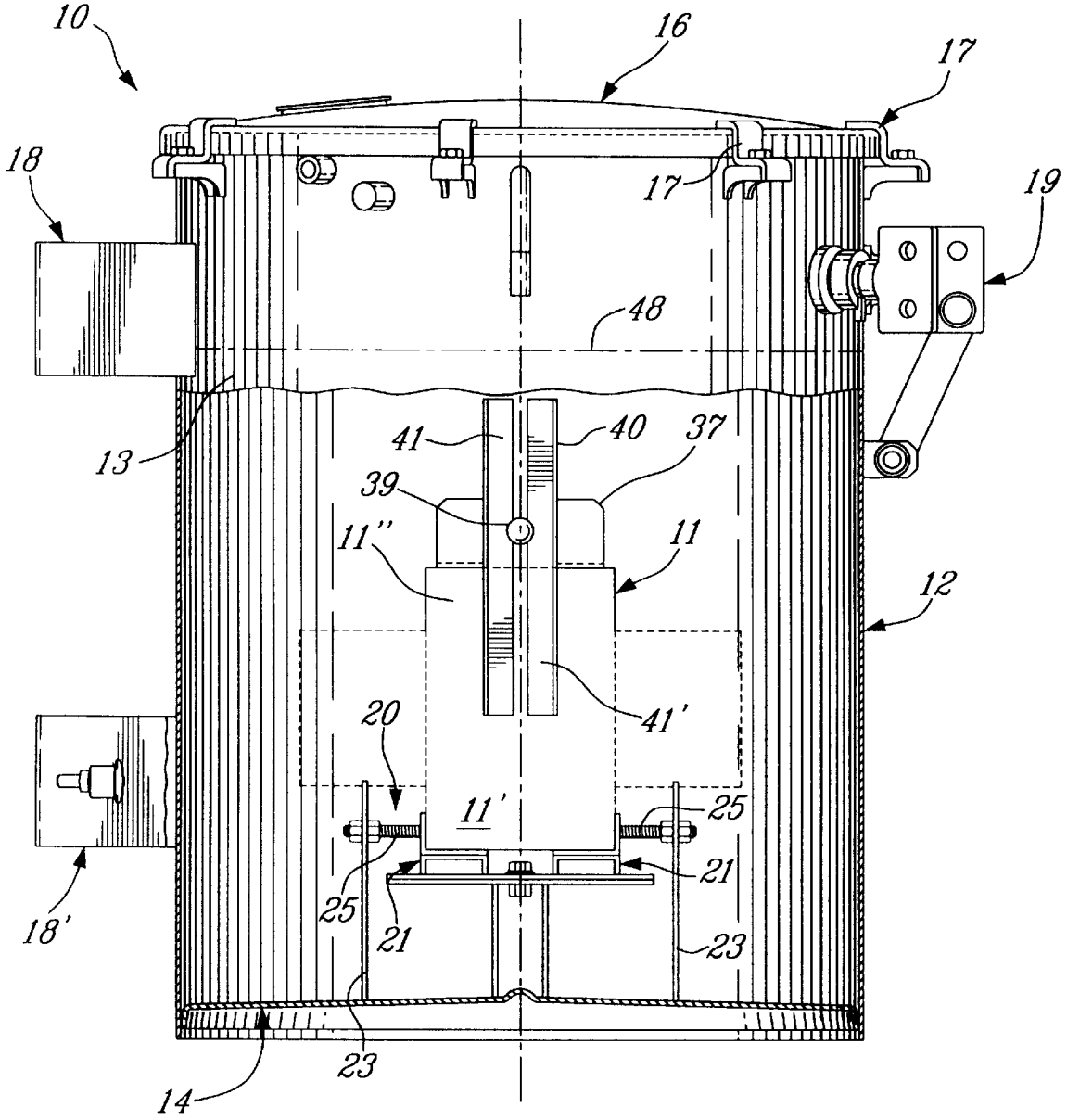
FIG. 1 is a fragmented side view of the universal transformer tank of the present invention.
Figure 2:
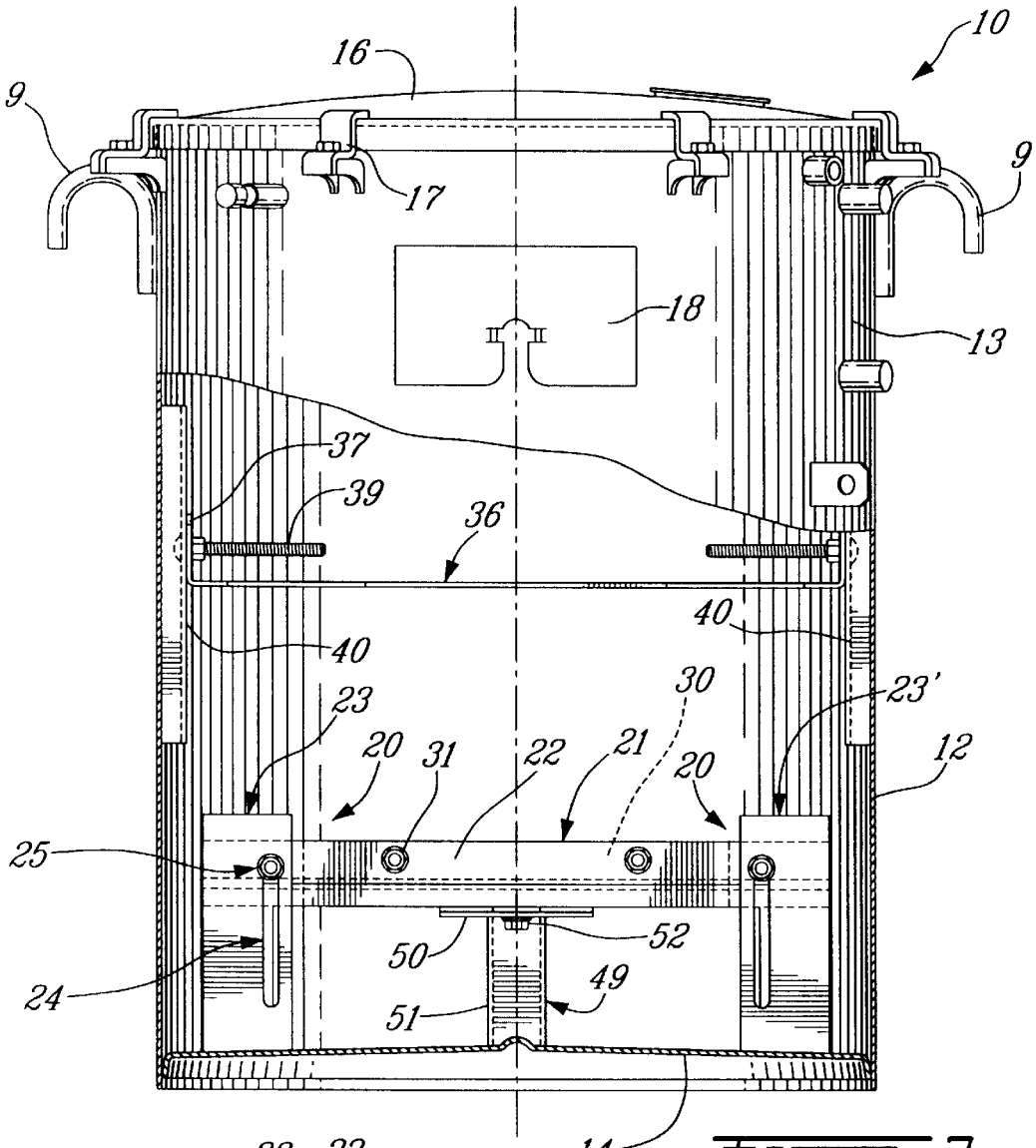
FIG. 2 is a side view, similar to FIG. 1 but viewed at right angle.
Figure 4:
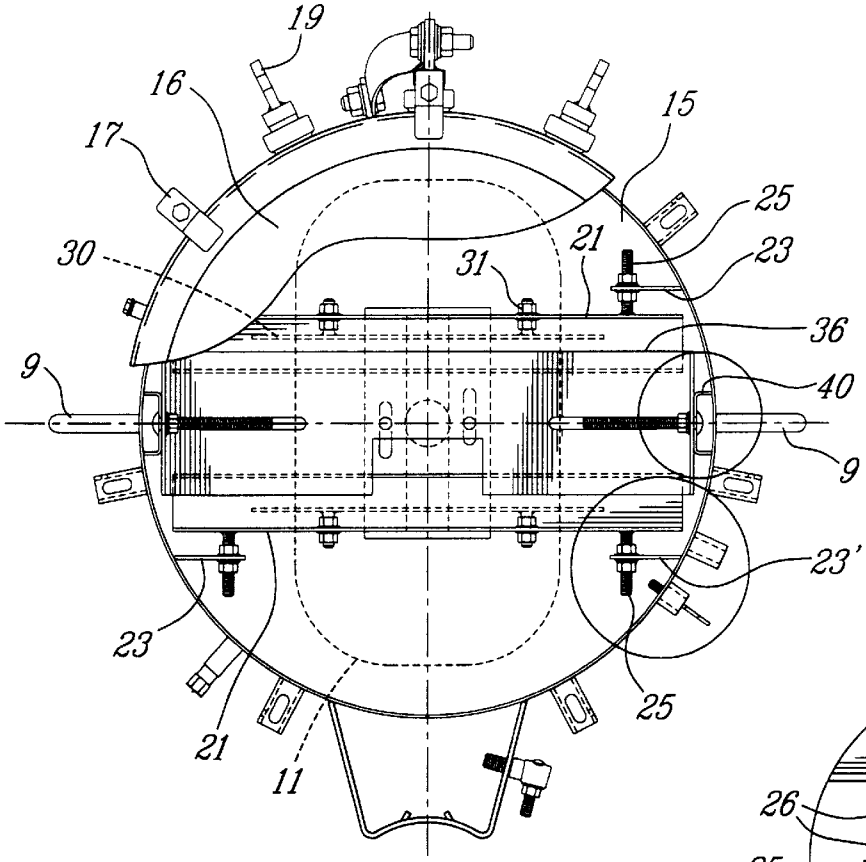
FIG. 4 is a fragmented top view of the universal transformer tank of the present invention.

Referring now to the drawings and more particularly to FIGS. 1 and 2 there is shown generally at 10 the universal transformer tank of the present invention for securing therein one of a plurality of different size and capacity core and coil assembly, such as the one illustrated in phantom line designated by reference numeral 11. The tank 10 comprises a cylindrical housing 12 which defines a circumferential side wall 13, a bottom wall 14 and an open top end 15 as more clearly seen in FIG. 4. A cover 16 is removably secured on the open top end 15 and clampingly secured thereabout by cover clamps 17 secured to the side wall 13 at predetermined positions. Lifting lugs 9 are secured to the side wall 13 of the housing to transport the tank with the transformer therein.

The tank 10 is a pole-mounted tank and is provided with an upper hanger lug 18 and a lower hanging lug 18' welded to its side wall 13. Terminal connectors 19 are also secured to the tank side wall. Other standard equipment such as a pressure release valve, a grounding strap etc. is provided on the housing.

The novel feature of the universal transformer tank as herein described is the provision of an adjustable clamping assembly 20 which is secured inside the housing 12 above the bottom wall 14 and having adjustable clamping means to secure core and coil assembly 11 of varying sizes inside the same tank. The clamping means is comprised by a pair of parallel support plates 21, the construction of which is better illustrated in FIG. 3. The support plates are constituted by an inverted U-shaped steel channel 21' and an angle steel plate 21" secured to the inverted steel channel 21'. The angle steel plate 21" provides a vertical clamping flange 22. Each of the support plates 21 are adjustably secured between a pair of support brackets 23 and 23' and at one of a plurality of predetermined vertical positions which are determined by slotted holes 24. A connecting fastener 25 secures the plates 21 to the holes 24 whereby the support plate lies at a selected one of a plurality of vertical predetermined positions.

Adjustable means is provided to displace the vertical clamping flange 22 of the support plates 21 to provide an adjustment having 100 mm whereby to clamp a lower end portion 11' of the core 26 of the transformer 11 as illustrated in FIG. 1 therebetween depending on the configuration and size of the core and coil assembly. The accurate location of support plates 21 is selected on the slotted holes 24 to receive the connecting fastener 25.

Figure 6:
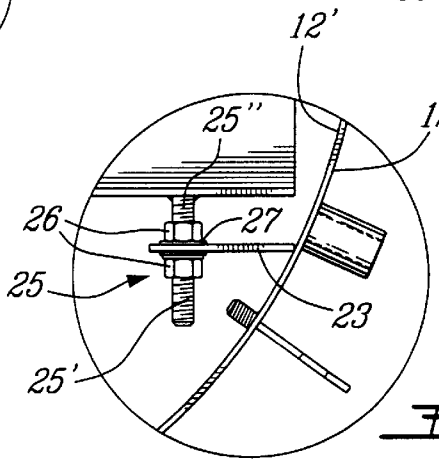
FIG. 6 is an enlarged view showing the adjustable connection of the support plates to the support brackets.

As better seen if FIG. 6 the support brackets 23 are welded to the inner face 12' of the tank side wall 12 and project over the bottom wall 14, see FIGS. 1 and 2. The adjustable means or connecting fasteners 25 is provided as a threaded stud and has an elongated bolt stem 25' which extends freely through a selected one of the slotted holes 24 which are unthreaded holes. The threaded stud is welded at an end 25" thereof to adjacent opposed ends of the support bracket 21, herein to the vertical clamping flange 22. A lock nut assembly 26 consisting of a pair of lock nuts and lock washers 27 is engageable with the bolts stem 25' for immovably securing same to the vertical clamping flange 22 of the support brackets and at a selected location of slotted holes 24 whereby the support plates are maintained parallel to one another. A supporting stand 49 consisting of a steel plate 50 welded on a steel pipe 51 which have to be cut depending on the location of support plates 21 is provided to ensure a solid base to the core and coil assembly connecting fasteners 52 is provided, bolts, lock washers and flat washers to secure and maintain immovable the supporting stand 49.

Figure 3:
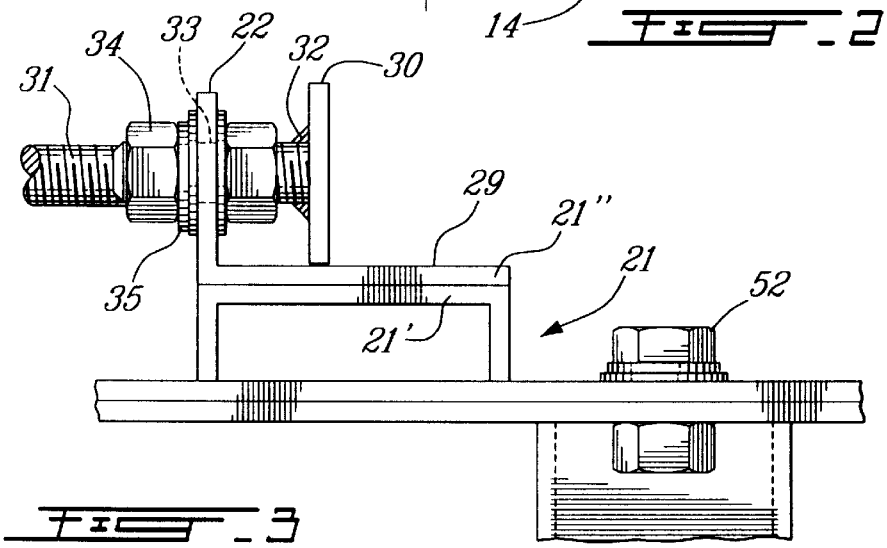
FIG. 3 is an enlarged section view of the support plate illustrating an optional adjustable clamping bar secured to the vertical clamping flange of the support plate.
Figure 5:
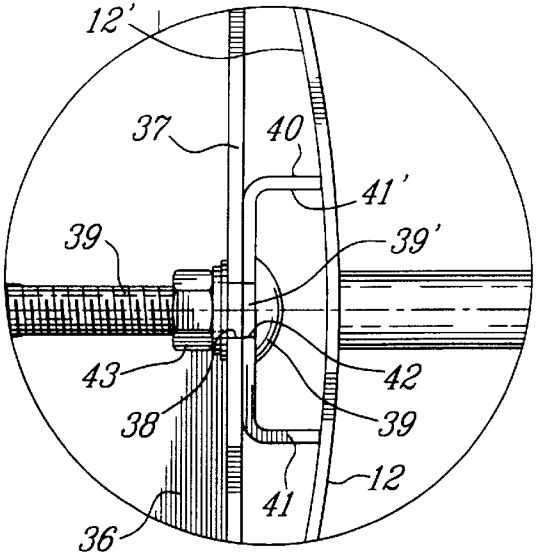
FIG. 5 is an enlarged top view illustrating the connection of the adjustable hold-down plate.

With reference to FIG. 3 there is shown an optional modification of the support plates wherein an adjustable clamping bar 30 is adjustably disposed over the top surface 29 of the angle steel plate 21" and extends substantially parallel to the vertical clamping flange 22. The adjustable clamping bar 30 is displaceable away from the clamping flange 22 by adjustable means which is constituted by two or more elongated threaded studs 31 welded at an end 32 to the clamping bar 30 at spaced locations therealong and secured to associated unthreaded holes 33 provided in the vertical clamping flange 22 and secured thereto by a lock nut assembly 34 and lock washer 35 in a manner similar to that as described with respect to the connecting fasteners 25. Accordingly, this adjustable clamping bar provides still further side adjustment to clamp transformer cores which are much narrower.

With reference to FIGS. 1, 2, 4 and 5 it can be seen that the universal tank 10 of the present invention is further provide with adjustable hold-down means in the form of a hold-down plate 36 which is an elongated flat steel bar having upturned end flanges 37 at opposed ends thereof. The flanges are provided with a through bore 38 to receive a bolt fastener 39, herein the stem of a carriage bolt fastener whereby to connect the hold-down plate between a pair of vertical channel members 40 which are diametrically secured such as with welding, to the inner surface 12' of the tank side wall 12, as clearly shown in FIG. 5.

The vertical channel members 40 are constituted by a pair of elongated steel angles 41 and 41' welded to the inner surface 12' of the side wall 12 and spaced-apart to define an elongated vertical connecting slot 42 therebetween. The connecting slot is sized to receive the square or hexagonal nut section 39' of the carriage bolt 39 in close sliding fit therein and prevent the bolt from turning. The nut 43 secures the flange 37 firmly against the vertical channel member 40 whereby to clamp-down the transformer core 26, as is better illustrated in FIG. 1. Accordingly, the transformer is immovably secured in position within the cylindrical housing 12. After the transformer is installed and the proper connections made inside the tank insulating oil is inserted in the tank to the oil level line 48 as shown if FIG. 1. as is well known in the art.

It is noted that it is within the ambit of the present invention to cover any obvious modifications of the preferred embodiment described herein, provided such modifications fall within the scope of the appended claims.

What is claimed is:

1. A universal transformer tank for securing therein distribution transformers of different configurations and sizes, said tank comprising a cylindrical housing having a circumferential side wall, a bottom wall and an open top end; a cover removably secured on said open top end, an adjustable clamping assembly secured inside said housing above said bottom wall to clamp a lower core section of a distribution transformer, said adjustable clamping assembly having adjustable clamping means to secure to a lower core section of varying sizes inside said housing, said adjustable clamping means including a pair of parallel support plates, each said plates being adjustably secured between a pair of permanently affixed support brackets at one of a plurality of vertical positions, and adjustable means to displace a vertical clamping flange of said support plates towards or away from one another to clamp a lower core section of a distribution transformer disposed across said pair of parallel support plates and supported by a supporting stand providing a solid base.

2. A universal transformer tank as claimed in claim 1 wherein there is further provided an adjustable clamping bar displaceably connected to said vertical clamping flange and displaceable away from said vertical clamping flange over a horizontal support wall of said support plate by adjustable connecting means.

3. A universal transformer tank as claimed in claim 2 wherein said adjustable connecting means is constituted by two or more elongated threaded bolts welded at an end to said clamping bar at spaced locations and secured to associated unthreaded holes provided in said vertical clamping flange by lock nut assemblies.

4. A universal transformer tank as claimed in claim 1 wherein there is further provided adjustable hold-down means to clampingly engage an upper core section of said core and coil assembly supported in said housing on said support plates.

5. A universal transformer tank as claimed in claim 4 wherein said support brackets are secured to an inner face of said side wall and project over said bottom wall of said tank housing, each said support brackets having vertically slotted holes to receive a connecting fastener to secure said support plates at a selected one of said plurality of vertical positions.

6. A universal transformer tank as claimed in claim 5 wherein said adjustable means is constituted by said connecting fasteners being provided as threaded bolts having an elongated bolt stem extending freely through a selected one of said slotted holes which are unthreaded holes, said threaded bolt stem being welded at an end thereof adjacent opposed ends of each said support plates, and a lock nut assembly engageable with said bolt stem for immovably securing same to an associated one of said support brackets at a common one of said plurality of slotted holes.

7. A universal transformer tank as claimed in claim 6 wherein said elongated bolt stem is welded adjacent opposed ends of said vertical clamping flange of said support plates.

8. A universal transformer tank as claimed in claim 4 wherein said adjustable hold-down means is a hold-down plate adjustably connected at opposed ends thereof to a vertical channel member of a pair of channel members diametrically secured to an inner surface of said side wall.

9. A universal transformer tank as claimed in claim 8 wherein said vertical channel member is constituted by a pair of elongated steel angles welded to said inner surface of said side wall and spaced apart to define an elongated vertical connecting slot therebetween, said hold-down plate having upturned end flanges at said opposed end thereof for receiving a bolt fastener engageable in an associated one of said slots of said vertical channel member and a securement bore provided in said upturned flanges.

10. A universal transformer tank as claimed in claim 9 wherein said bolt fastener is a carriage bolt fastener.

11. A universal transformer tank as claimed in claim 1 wherein said tank is a pole-mounted tank, said tank being dimensioned to receive therein one of a plurality of differently configured and size distribution transformers of differing capacities from about 25 kVA to 167 kVA.

* * * * *